United States Patent [19]

Russell

[11] 4,179,063

[45] * Dec. 18, 1979

[54] FEED AND SEVERING APPARATUS

[75] Inventor: David B. Russell, Southboro, Mass.

[73] Assignee: Dennison Manufacturing Company, Framingham, Mass.

[ * ] Notice: The portion of the term of this patent subsequent to Apr. 6, 1993, has been disclaimed.

[21] Appl. No.: 862,249

[22] Filed: Dec. 19, 1977

Related U.S. Application Data

[63] Continuation-in-part of Ser. No. 671,518, Mar. 29, 1976, abandoned.

[51] Int. Cl.[2] ..... B25C 1/00

[52] U.S. Cl. ..... 227/67; 227/19

[58] Field of Search ..... 266/19, 67

[56] References Cited

U.S. PATENT DOCUMENTS

| | | | |
|---|---|---|---|
| 3,643,851 | 2/1972 | Green et al. | 227/19 |
| 3,875,648 | 4/1975 | Bone | 227/67 X |
| 3,948,128 | 4/1976 | Russell | 227/67 X |

*Primary Examiner*—Paul A. Bell

*Attorney, Agent, or Firm*—George E. Kersey

[57] ABSTRACT

Apparatus for feeding and severing fastener attachment stock. The stock is formed by elongated side members that are intercoupled by a plurality of spaced apart cross links. The side members are fed and severed between adjacent cross members to form individual fastener attachments.

15 Claims, 20 Drawing Figures

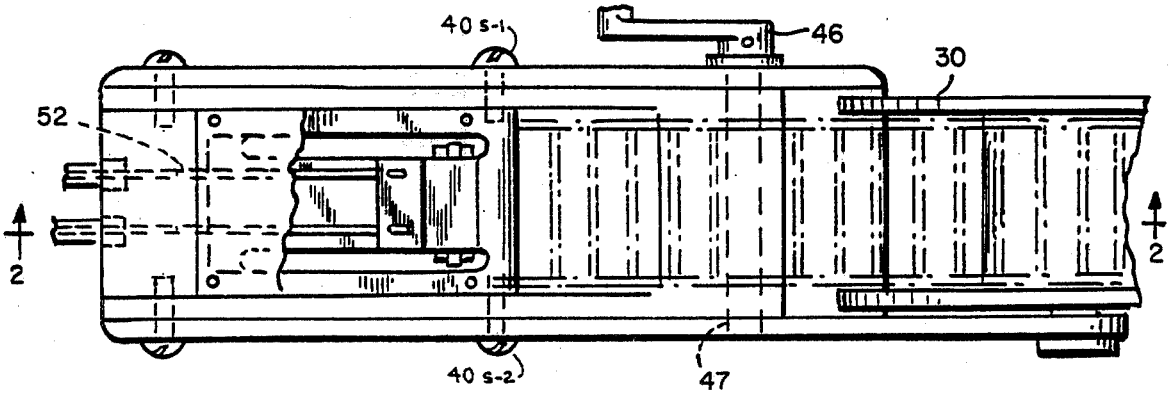
FIG. 1
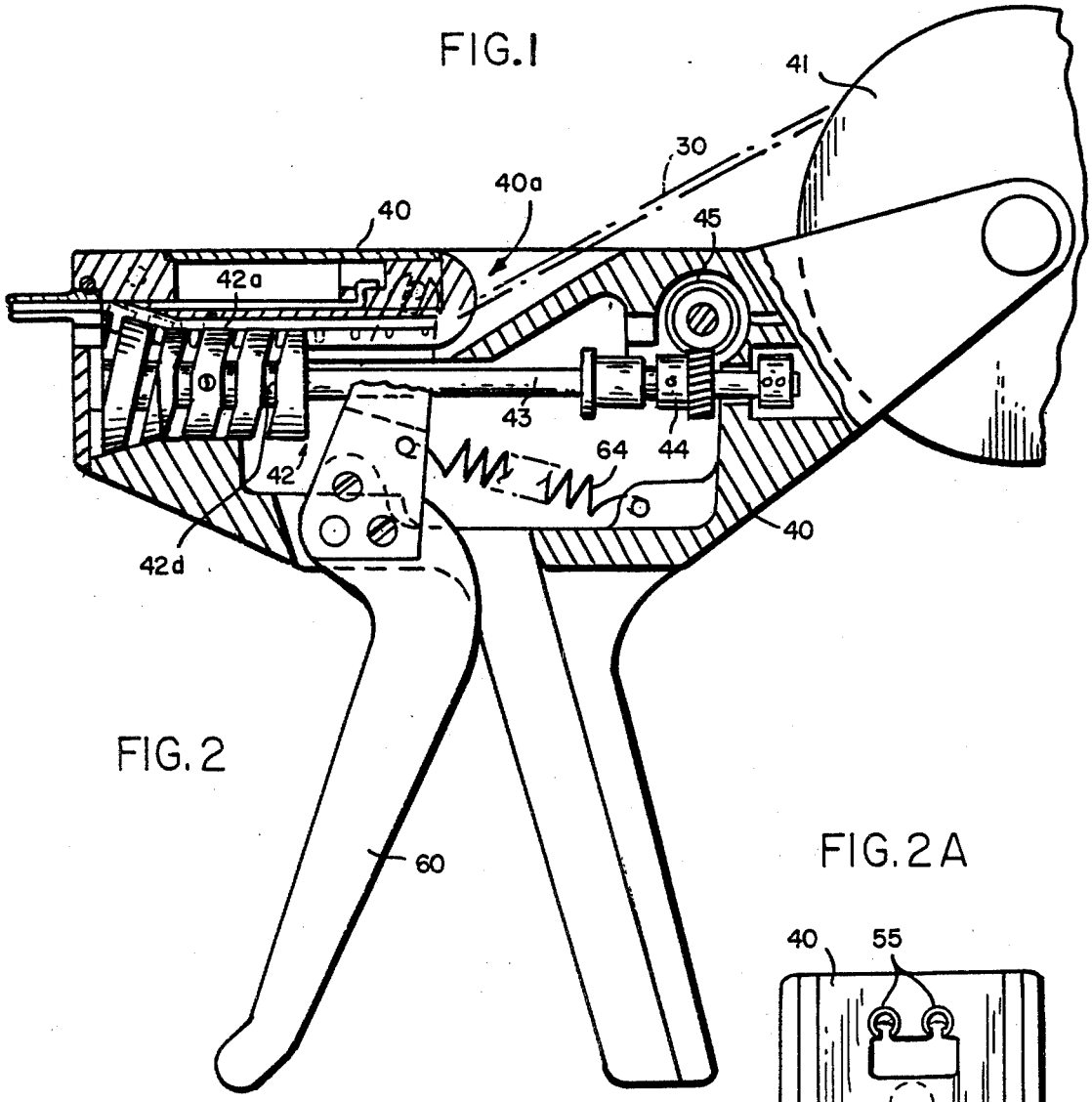
FIG. 2
FIG. 2A
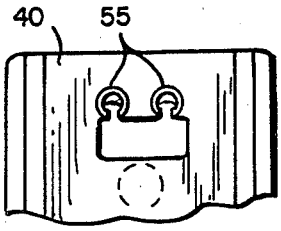

FEED AND SEVERING APPARATUS

BACKGROUND OF THE INVENTION

This is a continuation-in-part of Ser. No. 671,518, "FEED AND SEVERING APPARATUS, " filed Mar. 29, 1976 now abandoned.

The invention relates to apparatus for feeding and dispensing attachments and, more particularly, to apparatus which feeds fastener attachment stock, severs the stock into individual attachments, and dispenses the individual attachments.

One type of dispenser for fastener attachment stock is disclosed in U.S. Pat. No. 3,875,648, issued Apr. 8, 1976, and U.S. Pat. No. 3,948,128, issued Apr. 6, 1976. In these patents, the fastener attachment stock is formed by two elongated and continuous plastic side members intercoupled by a plurality of plastic cross links, which are preferably spaced apart equidistantly.

The stock may be produced from flexible plastics materials such as nylon and polyethylene, by molding, stamping to provide attachment stock of the kind illustrated in FIGS. 17 and 18, infra.

In U.S. Pat. Nos. 3,875,648 and 3,948,128 the stock is severed by relatively moveable die members to form fastener attachments that are dispensed through one or more hollow slotted needles, after appropriate positioning.

Such attachments can be dispensed to couple buttons to fabric, merchandising tags to articles of commerce, and in the general attachment of one item to another, such as the attachment of tubing to a chasses or electrical wiring to a frame.

Representative prior art dealing with individual fasteners is to be found in the following U.S. Pat. Nos. 3,103,666, 3,470,834, 3,494,004, 3,185,367, 3,650,451, 3,650,452, 3,652,004, 3,734,375 and 3,299,483.

SUMMARY OF THE INVENTION

In the practice of the invention, fastener attachment stock formed by cross coupled side members, is advanced by machine to a position for being dispensed and severed without interrupting the advance of the side members.

In accordance with one aspect of the invention at least one slotted needle is supported by the machine to receive at least one end member of a fastener, and the machine includes a plunger for pushing the end member through the slot of the needle.

In accordance with a further aspect of the invention, the fasteners are advanced to a position for being dispensed by a screw thread which is movable relative to a cross coupling member of the stock and engages the member between portions of the thread, particularly by side portions of the thread, which can be formed by a single screw thread.

In accordance with still another aspect of the invention, the advancing mechanism can include an integral cutter and positionally adjustable guides can be included for the side members.

In accordance with yet another aspect of the invention, the screw thread advances the stock linearly over a first region and at an incline with respect to said first region over a second region.

Channels can be provided for guiding the side members, with the channels being spaced apart by an interval which is less than the length of the cross coupling joining the side members, so that the cross coupling forms an open loop during its advance by the screw thread.

According to yet another aspect of the invention, a taper is provided in the outside diameter of the feed screw to effect positioning of the fastener attachments relative to plungers for dispensing the attachments through needles.

According to an additional aspect of the invention, a plurality of movable side member guides are provided, at least one of which supports a dispensing needle. The guides are movable with respect to one another to alter their relative spacing.

According to a further aspect of the invention, the feed of fastener attachment stock is effected by engagement of cross links with the sides of feed screw threads, and the side members are severed from the stock.

DESCRIPTION OF THE DRAWINGS

Other aspects of the invention will become apparent from consideration of several embodiments, taken with the drawings in which:

FIG. 1 is a partial top view of a feed and severing apparatus in accordance with the invention;

FIG. 2 is a sectional view of the apparatus of FIG. 1 taken along lines 2—2;

FIG. 2A is a partial view of the feed and severing apparatus of FIG. 1 taken from the front;

DETAILED DESCRIPTION

Figure 17:
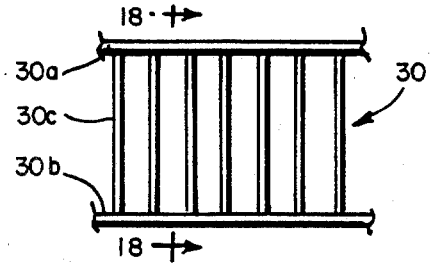
FIG. 17 is a plan view illustrating a section of fastener attachment stock.
Figure 18:
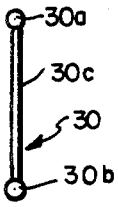
FIG. 18 is a cross sectional view of the stock of FIG. 17.

The feed and severing apparatus in accordance with the invention is employed in conjunction with ladder stock of the kind illustrated in FIGS. 17 and 18. A strip 30 of fastener attachment stock shown there is formed by side members 30*a* and 30*b* that are cross coupled by links 30*c*. The stock 30 may be of plastic with side members and cross links that are preferably round in cross section. The side members 30*a* and 30*b* desirably have a diameter greater than that of the cross links 30*c*, which may be positioned equidistantly from one another to obtain uniformly dimensioned fastener attachments after severing of the side members has taken place. Such a fastener 35 is illustrated in FIG. 19 with two side members 35*a* and 35*b* which are cross coupled by link 35*c*.

Figure 19:
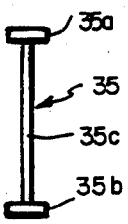
FIG. 19 is a side view of a fastener attachment formed from the stock of FIG. 17.

The stock and fasteners of FIGS. 17 through 19 are illustratively fed and severed according to the invention by the apparatus of FIGS. 1–8.

The apparatus (FIG. 2) has body or frame 40 which supports a storage unit at one end, such as a reel 41 that holds a roll of fastener attachment stock 30.

Within the apparatus, the stock 30 is threaded through a body opening 40*a* to a feed screw 42 that is formed by a rod with a plurality of spiral threads 42*a* that engage and advance the stock 30.

The feed screw 42 is rotated by a shaft 43 which is positioned in a bore in the body or frame 40 and is in turn coupled to a gear 44. The gear 44 is positioned as shown in the body of the apparatus and is rotated by another gear 45 driven by a handle 46 (FIG. 1) coupled to a shaft 47 upon which a gear 45 is mounted.

It will be understood that the screw feed can be rotated in a wide variety of ways and that the particular disclosure of FIGS. 1–8 is merely illustrative.

Figure 3:
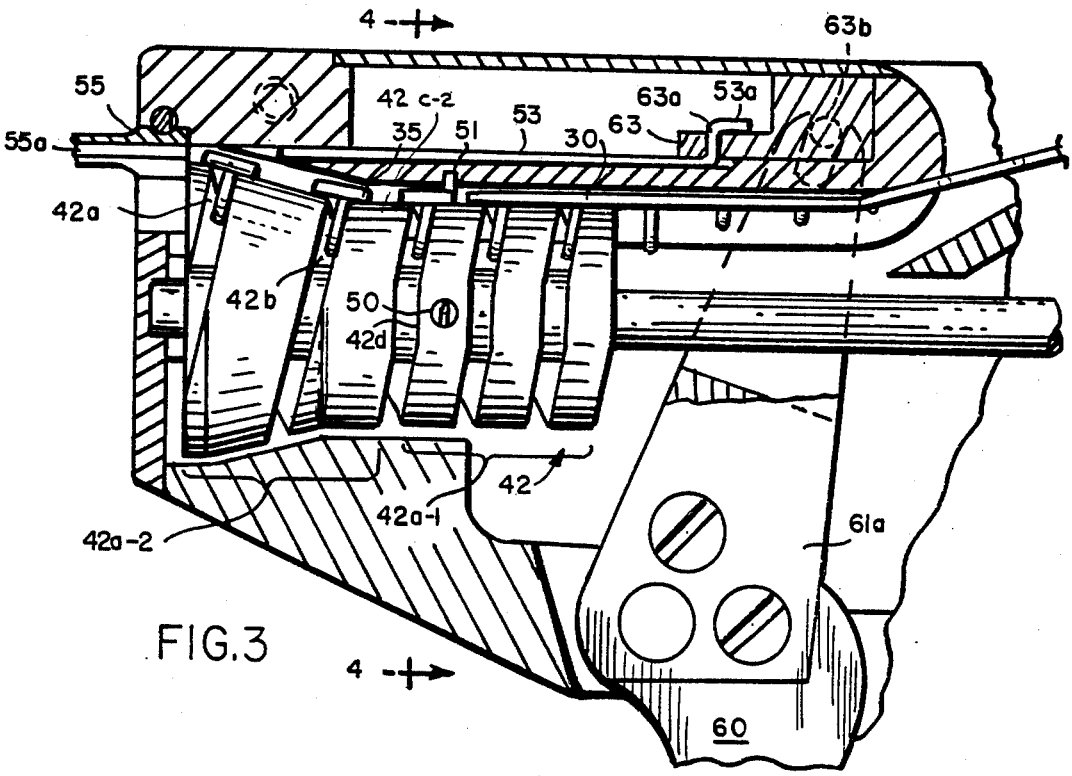
FIG. 3 is an enlarged partial view of FIG. 2 showing the feeding and severing of fastener stock.
Figure 4:
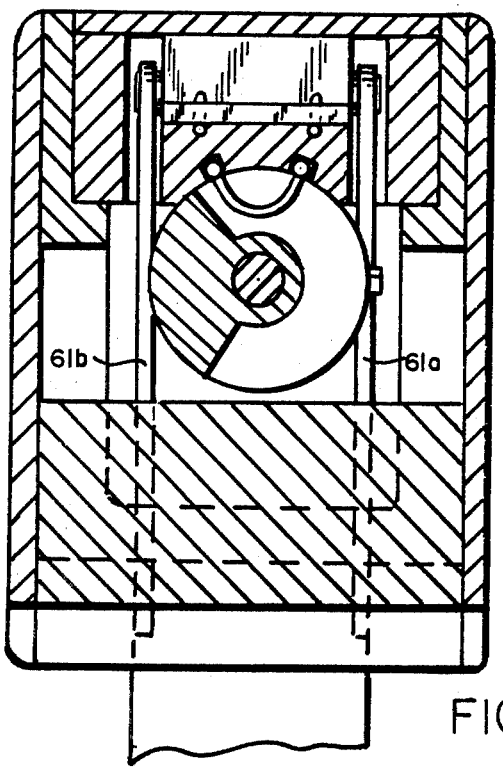
FIG. 4 is a sectional view of the apparatus of FIG. 3, taken along lines 4—4.
Figure 5:
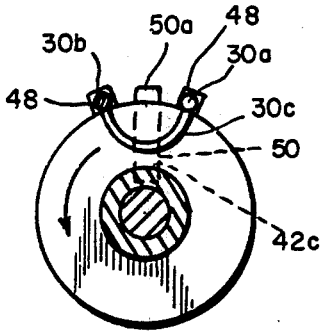
FIG. 5 is a diagrammatic sectional view similar to that of FIG. 4 showing the cutting of stock to form an individual fastener attachment.

The stock 30 is confined within guide channels 48 (FIGS. 7 and 8) which cause cross links 30*c* to form partial loops as shown in FIGS. 4 and 5. The loops are captured or positioned between the screw threads 42*a* in recesses or cavities 42*b* as shown in FIG. 3. Individual attachments are severed from the stock and both are advanced upon turning of the screw 42. The channels 48 are in a top, removable body portion (FIG. 2) which can be coupled to the body by screws or snap fasteners (not shown).

As can be seen in FIG. 3, the screw feed 42 has a first set or group of threads, whose edges lie on the surface of a first cylinder, for advancing the stock, and a second set or group of threads, whose edges lie on the surface of a cone and a second cylinder 42*c*-2. The second cylinder 42*c*-2 provides a transition between the first group of threads 42*a*-1 and the second group of threads 42*a*-2, having a larger pitch than the first group. The first group of threads is shown at 42*a*-1 and the second group of threads is shown at 42*a*-2. The first group of threads 42*a*-1 has a pitch equal to the spacing between cross links 30*c* (FIG. 17). Threads 42*a*-1 advance the stock to a point where it is severed into fastener attachment devices 35 (see FIGS. 3, 6 and 19).

Figure 7:
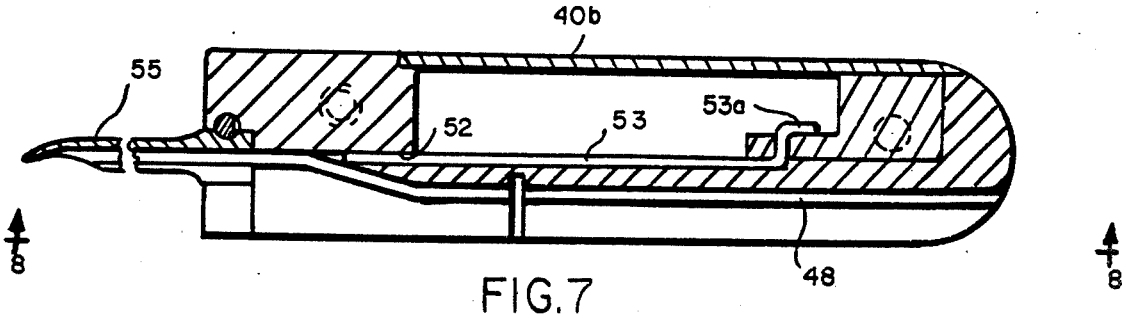
FIG. 7 is a sectional view of a portion of the apparatus of FIG. 3 taken along lines 7—7 in FIG. 8.

The second group of threads 42*a*-2 has a larger pitch than the first group of threads and serves to separate or space the devices 35 further apart from each other after they are cut. A portion of the second group of threads also increases in diameter to raise the fastener attachment devices 35 for dispensing through the needle by the plunger 53 (FIGS. 3 and 7).

Severing or cutting is achieved in this apparatus by the screw feed supported knife 50 (FIGS. 3 and 5) which is positioned above the threads 42 and preferably held within a bore 42*c* (FIG. 5) located within one of the threads.

The knife 50 is adapted to rotate with the feed screw, and in rotating, the blade 50*a* (FIG. 5) sequentially enters the guide channels 48 via cross slit or channel 51 (FIG. 3) to first sever, cut or slice through side member 30*a* and then sever stock side member 30*b* to provide the fastener attachment devices 35.

FIG. 5 illustrates the knife blade 50*a* having been rotated as shown by the arrow to cut through the stock side member 30*a* and being rotated to cut through the stock side member 30*b*. In order to preferably cut through the stock side members 30*a* and 30*b* while the stock is substantially stationary a dwell is provided in the threads at 42*d* (see FIG. 3).

Figure 8:
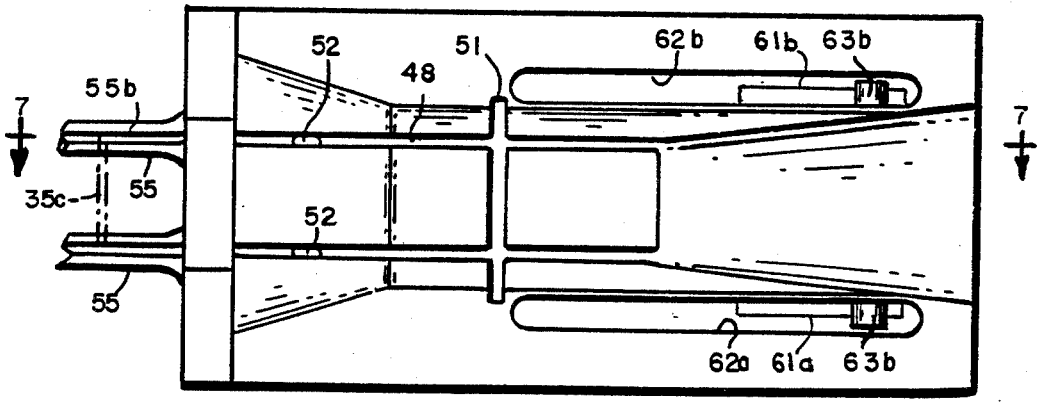
FIG. 8 is a bottom view of the unit of FIG. 7 taken along lines 8—8.

In the body top portion of FIGS. 7 and 8 (which includes channels 48 and 51 in FIG. 8 and is normally removed to thread stock into the feed screw), there are provided channels 52 in which plungers 53 are movable. The top portion 40*b* is shown removed from the frame 40 in FIG. 7. It is positioned in the frame 40 in a recess provided for that purpose as shown in FIG. 2 and held in place by screws 40*s*-1 and 40*s*-2 shown in FIG. 1.

Figure 6:
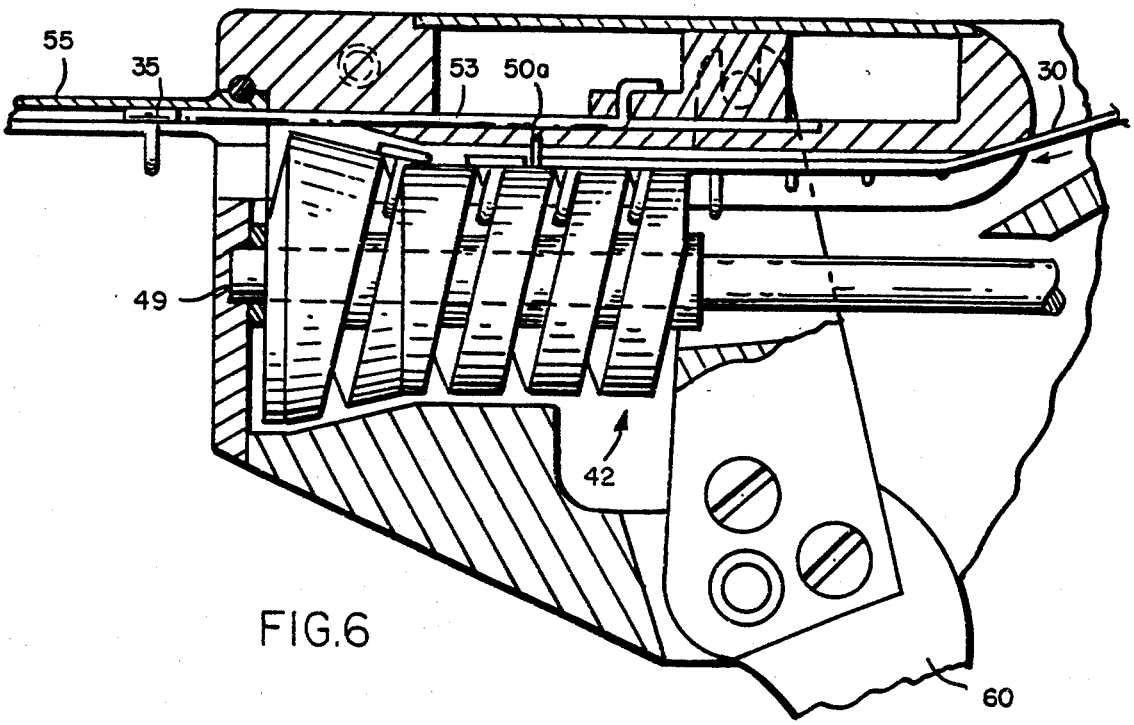
FIG. 6 is a sectional view similar to that of FIG. 3 illustrating the feeding of fastener attachments through the needle of the apparatus.

The plungers 53 are positioned for reciprocating movement and enter the channels 48 at the rear of the point where the screw thread group 42*a*-2 raises and advances a fastener attachment device 35 into the bores 55*a* of two needles 55 (see FIGS. 3 and 6). After, for example, the ends 35*a* and 35*b* of the fastener attachment device 35 illustrated in FIG. 19 have been positioned by rotation of the screw 42 at the entrance of respective bores 55*a* of the needles 55 shown in FIG. 8, the ends 35*a* and 35*b* are advanced by the plungers 53 of FIGS. 3 and 7.

During the passage through the needle bores 55*a*, the loops 35*c* of the devices extend between the two needles 55 (see dotted line in FIG. 8), through needle slots 55*b*.

In order to move the plungers 53, there is provided a pivotally mounted squeeze handle 60 (FIG. 3) supporting slide pushers 61*a*.

Within the body portion 40*b* (FIG. 3) there is provided a slide 63 which supports in bores the L shaped ends 53*a* of the plungers 53. The slide 63 carries pins 63*b* which are positioned in U-shaped cutouts at the top of members 61*a* and 61*b*.

A spring 64 (FIG. 2) is provided to retain the handle apart and keep the slide 63 retracted.

Figure 9:
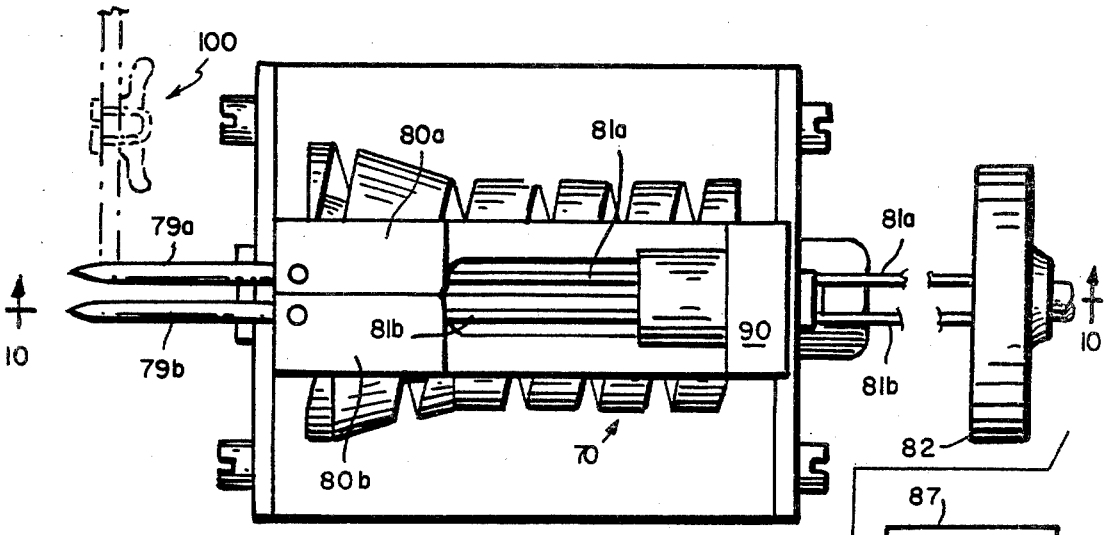
FIG. 9 is a plan view of a further embodiment of the invention.
Figure 10:
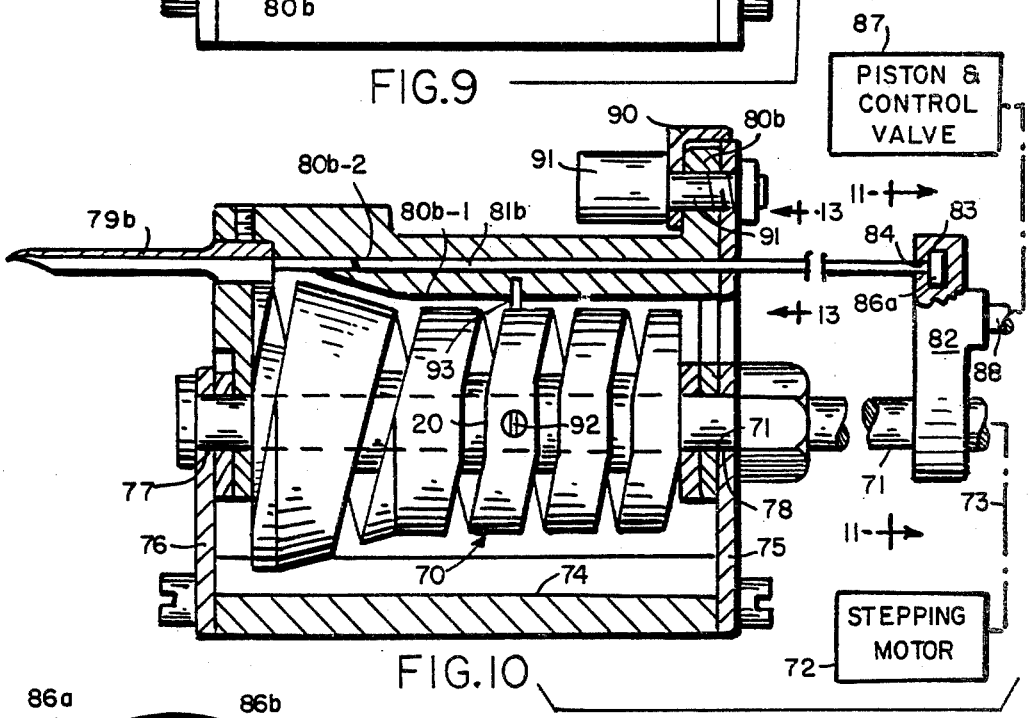
FIG. 10 is a sectional view of the embodiment of FIG. 9 taken along lines 10—10.
Figure 11:
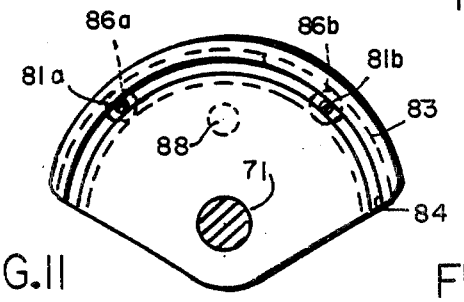
FIG. 11 is a sectional view of a portion of FIG. 10 taken along lines 11—11.
Figure 12:
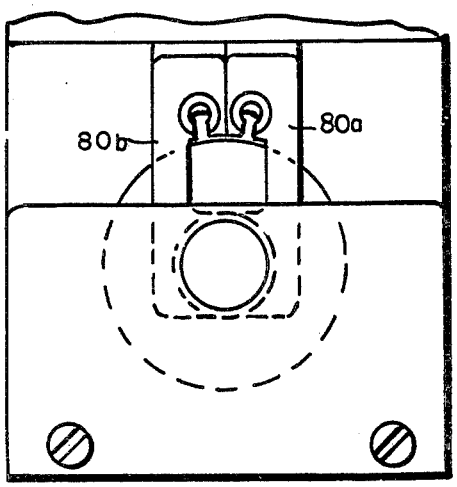
FIG. 12 is a front view of the embodiment of FIG. 9 illustrating the adjustment of needle and guide spacing.
Figure 13:
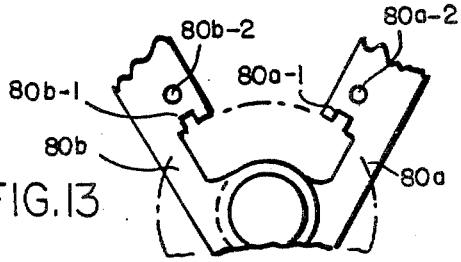
FIG. 13 is a sectional view of FIG. 10 taken along lines 13—13.

An alternative embodiment of the disclosure is shown in FIGS. 9 through 13. In this embodiment a feed screw 70 is supported for rotation on a shaft 71 which is journalled in opposite base members 75 and 76 by bearings 77 and 78. The shaft 71 is incrementally rotated by hand, or by a stepping motor 72. The latter is operable through a gear train illustratively represented by the connecting line 73 shown in FIG. 10. In the embodiment of FIGS. 9 and 10, needles 79*a* and 79*b* are mounted in pivotable members 80*a* and 80*b* containing stock guide channels 80*a*-1 and 80*b*-1 shown in FIG. 13. The pivotable members 80*a* and 80*b* also contain plunger guide apertures 80*a*-2 and 80*b*-2 of the same general configuration as the plunger guide apertures 48 in FIG. 5. Plunger elements 81*a* and 81*b* can be reciprocated in the plunger guide apertures 80*a*-2 and 80*b*-2 using the plate member 82 shown in FIGS. 9 and 10. For that purpose the plate member 82 is movably mounted on the feed screw shaft 71 and the ends 86a and 86b of the plungers 81a and 81b are positioned in guide channels 83 and 84 (FIG. 11).

The plate member 82 can be reciprocated manually or by a fluid operated piston and control valve 87 (FIG. 10) that may be coupled to the plate 82 by a shaft 88.

In the embodiment of FIGS. 9 and 10 the slotted needles 79a and 79b are adjustable relative to one another by a clamp 90 which, as shown in FIG. 10 for the guide member 80b, contains a set screw and nut 91 that passes through both the clamp 90 and the guide member 80b. A similar arrangement (not shown) is used for clamping the remaining guide member 80a to the clamp 90.

The screw member 70 contains a knife element 92 (FIG. 10) which contacts the ladder stock and brings about its severance when the screw 70 is rotated.

In the embodiment of FIGS. 9 and 10 the separation of the needles is adjusted according to the kind of fastening operation that is to be undertaken. Thus, to fasten a button to a fabric backing as indicated at position 100 in FIG. 9 the separation of the needles 79a and 79b is made to correspond to the distance between holes in the button. Since the needles 79a and 79b are mounted in the respective guide members 80a and 80b, the desired separation is made by releasing the coupling 90, moving the members 80a and 80b about their axes of rotation as desired, and then clamping the guide members by the clamp 90.

Figure 14:
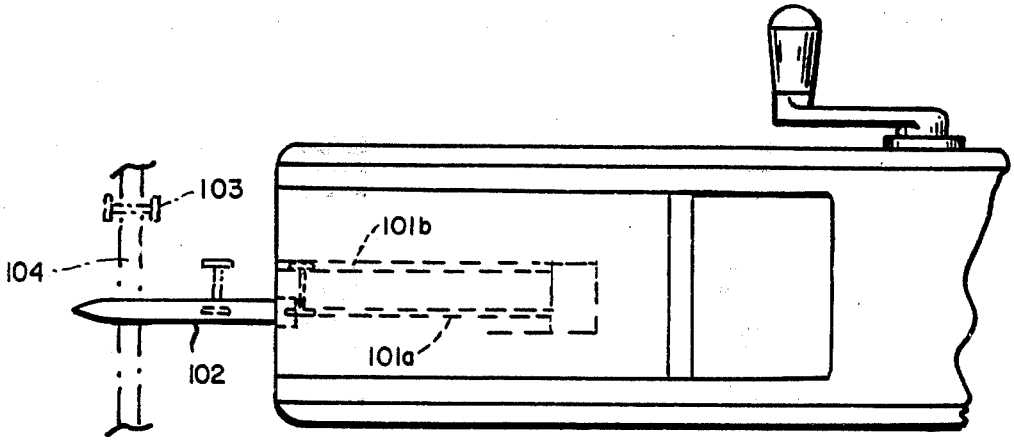
FIG. 14 is a top view of a single needle modification of the embodiment of FIGS. 1-8.

A further embodiment of the invention is shown in FIG. 14. In this embodiment dispensing channels 101a and 101b are used with only a single needle 102. Otherwise the embodiment of FIG. 14 is identical to that of FIGS. 1 through 8. The fastener attachment device to be dispensed travels within the apparatus in accordance with the description previously given for the apparatus of FIGS. 1 through 8. However, since there is only a single needle 102 only the portion 35b of the illustrated fastener 35 is within the bore of the needle. Consequently when the apparatus is used in conjunction with an illustrative member, such as the fabric member 104 of FIG. 14, the end 35b within the bore of the needle appears at the far side of the fabric, while the remaining end 35a appears at the near side, as illustrated by the representative attachment device 103.

Figure 15:
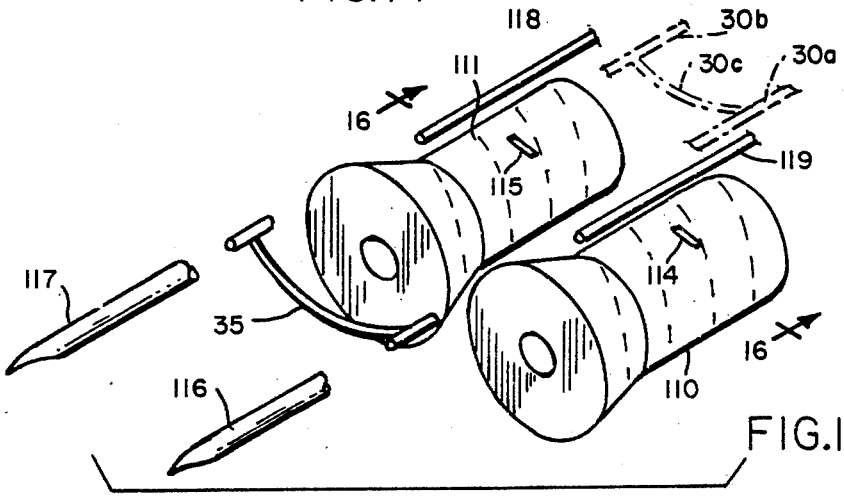
FIG. 15 is a perspective illustrating the use of two screws for advancing and severing stock in accordance with the invention.
Figure 16:
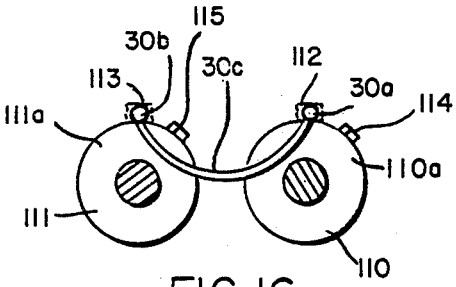
FIG. 16 is a sectional view of FIG. 15 taken along lines 16—16.

A further embodiment of the invention is illustrated in FIGS. 15 and 16. In this embodiment the single screw arrangements of the embodiments of FIGS. 1 through 8, and FIGS. 9 and 10 is replaced by twin feed screws 110 and 111. The latter are desirable for the feeding of stock having a particularly long cross link 30c. It will be understood that the screw members 110 and 111 are shown in outline form only and are constructionally identical to the feed screw 70 of FIGS. 9 and 10 and the feed screw 42 of FIG. 3. In the embodiment of FIGS. 15 and 16 the partial loops formed by the cross links, such as the cross link 30c, extend between the two screws as illustrated in FIG. 16, along the face of an illustrative thread 110a for the feed screw 110, then bridging the interval of separation between the two feed screws, and finally along the face of the illustrative thread 111a of the second feed screw 111. The side members 30a and 30b are held in position within channels 112 and 113 as shown in FIG. 16. The channels 112 and 113 correspond to the channels 80a-1 and 80b-1 of FIG. 13 and the channels 48 of FIGS. 4 and 5.

The severing of the stock in the embodiment of FIGS. 15 and 16 takes place through the use of separate knife members 114 and 115 mounted on the respective feed screws 110 and 111. The operation of each individual knife member is the same as for the knife member 92 of the feed screw 70 shown in FIG. 10, and the knife member 50 of the feed screw 42 shown in FIG. 3.

When the feed screws 110 and 111 rotate to position the knife members 114 and 115 against the side members of the ladder stock, the subsequent rotation produced the desired severing, and the result is the illustrative attachment member 35 shown in FIG. 15 preparatory to being fed into the needles 116 and 117. It will be understood that the movement of the side members 30a and 30b from the position of sever to the needles 116 and 117 is along the guide channels 112 and 113 illustrated in FIG. 16. The movement of the ends 30a and 30b through the bores of the respective needles 116 and 117 is then accomplished using the respective plungers 118 and 119.

The screws and plunger may be hand driven as previously disclosed or powered as disclosed in FIGS. 9–13.

From the above it should now be apparent that a new and improved dispensing apperatus has been provided as well as a new and improved method for advancing fastener attachment stock and fastener attachment devices.

In the light of this disclosure other embodiments or modifications will be understood to be encompassed by the various aspects of the invention.

I claim:

1. In a machine for dispensing fasteners, each having a pair of side members cross coupled by a link member, the improvement comprising means for advancing connected plurality of the fasteners to a position for being dispensed and means on the advancing means for severing each of said side members without interrupting the advance of said side members.

2. A machine according to claim 1 in which at least one slotted needle is supported by said machine to receive at least one end member of a fastener.

3. A machine according to claim 2 including a plunger for pushing said end member through the slot of said needle.

4. A machine according to claim 1 further including channels for guiding said side members, said channels being spaced apart by an interval which is less than the length of the link member joining said side members.

5. In a machine for dispensing fasteners, each having a pair of side members cross coupled by a link member, the improvement which comprises means for advancing the fasteners to a position for being dispensed through at least one slotted needle supported by said machine, the advancing means comprising a screw thread which is movable relative to said link member and engages said link member between portions of said thread.

6. A machine according to claim 5 wherein the sides of said thread engage said cross links.

7. A machine according to claim 5 wherein said advancing means comprises a single screw thread.

8. A machine according to claim 5 wherein the advancing means includes a cutter integrally included therewith.

9. A machine according to claim 5 wherein positionally adjustable guide means are included for said side members.

10. A machine according to claim 5 wherein said advancing means comprises a plurality of separate screw threads.

11. A machine according to claim 5 wherein guide means are included for said side members.

12. In a machine for dispensing fasteners, each having a pair of side members cross coupled by a link member, the improvement which comprises means for advancing the fasteners to a position for being dispensed, the advancing means comprising a screw thread which is movable relative to said link member, engages said link member between portions of said thread and advances said stock linearly over a first region and at an incline with respect to said first region over a second region.

13. A machine according to claim 12 further including a plunger for pushing at least one of said side members out of said machine.

14. A machine in accordance with claim 13 further including a plurality of convergent channels, one of said channels being for guiding at least one of said side members and the other of said channels being for housing said plunger.

15. In a machine for dispensing fasteners, each having a pair of side members cross coupled by a link member, the improvement comprising means for advancing the fasteners to a position for being dispensed and forcing each link member into an open loop configuration during the advance.

* * * * *